US007562407B2

(12) United States Patent
Kuo

(10) Patent No.: US 7,562,407 B2
(45) Date of Patent: Jul. 21, 2009

(54) AIR PERMEABLE FABRIC SHEET MEMBER

(76) Inventor: Chun Fu Kuo, No. 29, Avenue 32, Lane 667, Chonsan Road, Shern Gan Hsiang, Taichung Hsien 42950 (TW)

( * ) Notice: Subject to any disclaimer, the term of this patent is extended or adjusted under 35 U.S.C. 154(b) by 124 days.

(21) Appl. No.: 11/732,723

(22) Filed: Apr. 4, 2007

(65) Prior Publication Data

US 2008/0244832 A1 Oct. 9, 2008

(51) Int. Cl.
*B68G 5/00* (2006.01)

(52) U.S. Cl. ..... 5/655.5; 428/71

(58) Field of Classification Search ..... 5/655.5, 5/654, 644, 653, 652, 909, 952; 428/71
See application file for complete search history.

(56) References Cited

U.S. PATENT DOCUMENTS 3,251,075 A 5/1966 Saltness et al.
4,007,960 A 2/1977 Gaffney ..... 297/71
5,557,815 A 9/1996 Mintz et al. ..... 5/636
5,626,387 A 5/1997 Yeh ..... 297/180.14
5,692,952 A 12/1997 Chih-Hung ..... 454/120
6,842,926 B2 * 1/2005 Kuo ..... 5/655.5

* cited by examiner

*Primary Examiner*—Arti Singh-Pandey
(74) *Attorney, Agent, or Firm*—Charles E. Baxley

(57) ABSTRACT

A fabric sheet member includes a cover cloth layer, an inner cloth layer, and two or more longitudinal fabric elements disposed between the cover cloth layer and the inner cloth layer, and secured to the cover cloth layer and the inner cloth layer for forming one or more air circulating spaces between the longitudinal fabric elements and the cover cloth layer and the inner cloth layer. The longitudinal fabric elements may be secured to the cover cloth layer and the inner cloth layer with such as stitches. The longitudinal fabric elements may be made of resilient cotton materials or filament materials. The fabric sheet member may be attached to a pillow, a bed cushion, a seat cushion or the like.

7 Claims, 5 Drawing Sheets

AIR PERMEABLE FABRIC SHEET MEMBER

BACKGROUND OF THE INVENTION

1. Field of the Invention

The present invention relates to a fabric sheet member, and more particularly to an air permeable fabric sheet member including an air permeable structure for attaching onto various cushioning elements or devices and for allowing the cushioning elements or devices also to have an air permeable structure.

2. Description of the Prior Art

Typical cushioning elements or devices or facilities, such as pillows, seat cushions, beds, mattresses, or the like comprise an inner body made of such as foamable materials, foamed latex rubber materials, spongy materials, or other synthetic materials, and an expansible fabric covering attached or engaged onto the outer peripheral portion of the inner body for closely or sealingly enclosing and retaining the inner body within the expansible fabric covering.

For example, U.S. Pat. No. 3,251,075 to Saltness et al. discloses one of the typical inflatable pillows comprising an expandable air bladder, an intermediate enclosure or padding attached or engaged onto the outer peripheral portion of the expandable air bladder, and an outer covering attached or engaged onto the outer peripheral portion of the intermediate enclosure or padding.

However, the intermediate enclosure or padding is made of foamed latex rubber materials, and the outer covering is an expansible fabric covering attached or engaged onto the outer peripheral portion of the intermediate enclosure or padding such that the outer peripheral portion of the typical inflatable pillows has no air permeable structure and such that the users may feel hot and uncomfortable when using such inflatable pillows.

U.S. Pat. No. 4,007,960 to Gaffney discloses one of the typical chairs comprising a tiltable back and a raisable seat also including a solid configuration having no air permeable structure such that the users may also feel hot and uncomfortable when using such tiltable backs and/or raisable seats.

U.S. Pat. No. 5,557,815 to Mintz et al. discloses one of the typical pillow/chair pads comprising a flexible fabric sheet attached or engaged onto the outer peripheral portion of the inner cushion material. However, similarly, the flexible fabric sheet and the inner cushion material also include a solid configuration having no air permeable structure such that the users may also feel hot and uncomfortable when using such pillow/chair pads.

For forming an air permeable or circulating structure, the typical cushioning elements or devices or facilities may include a number of air conduits engaged into a resilient seat body, and a fan unit coupled to the air conduits for generating and blowing the air into or through the air conduits.

For example, U.S. Pat. No. 5,626,387 to Yeh discloses one of the typical seat cushions also comprising a number of air conduits engaged into a resilient seat body, and a fan unit coupled to the air conduits for generating and blowing the air into or through the air conduits.

However, the provision and the engagement of the air conduits into the resilient seat body may greatly increase the manufacturing cost of the typical seat cushions. In addition, the resilient seat body also include a solid configuration having no air permeable structure such that the users may also feel hot and uncomfortable when using such seat cushions.

U.S. Pat. No. 5,692,952 to Chih-Hung discloses another typical air-conditioned seat cushion comprising a top cushion and a bottom cushion having a number of air outlets, and a number of supporting cylinders disposed or attached between the top cushion and the bottom cushion, and a complicated air blowing device attached to the cushion for generating and blowing the air into or through the cushion.

However, the complicated air blowing device may also greatly increase the manufacturing cost of the typical air-conditioned seat cushion.

The present invention has arisen to mitigate and/or obviate the afore-described disadvantages of the conventional fabric sheet members for cushioning elements or devices.

SUMMARY OF THE INVENTION

The primary objective of the present invention is to provide a fabric sheet member including an air permeable structure for attaching onto various cushioning elements or devices and for allowing the cushioning elements or devices also to have an air permeable structure.

In accordance with one aspect of the invention, there is provided a fabric sheet member comprising a cover cloth layer, an inner cloth layer, and at least two longitudinal fabric elements disposed between the cover cloth layer and the inner cloth layer, and secured to the cover cloth layer and the inner cloth layer for forming at least one air circulating space between the longitudinal fabric elements and the cover cloth layer and the inner cloth layer.

The longitudinal fabric elements are secured to the cover cloth layer and the inner cloth layer with stitches. The longitudinal fabric elements are made of resilient cotton materials or resilient filament materials.

The fabric sheet member is attachable onto an outer peripheral portion of an inner cushioning member for forming such as a pillow, a bed cushion, a seat cushion or the like.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
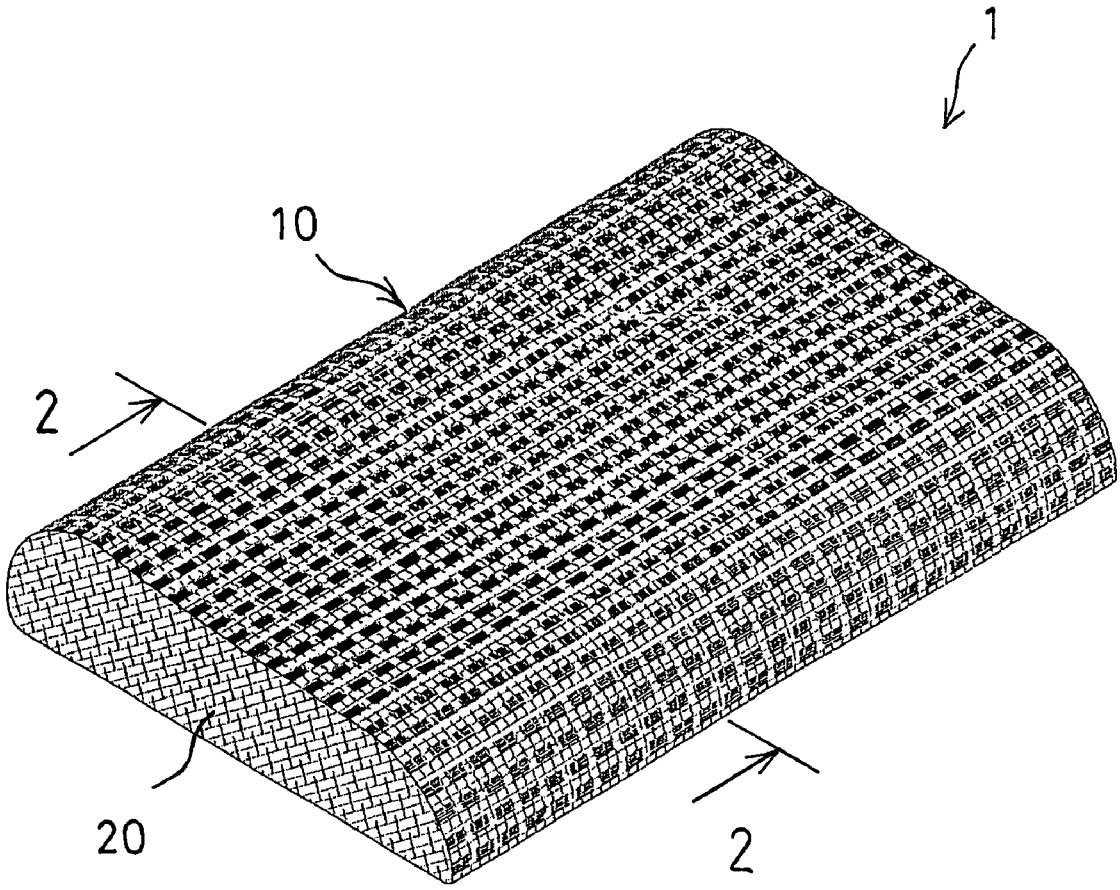
FIG. 1 is a perspective view illustrating one example of the cushioning elements or devices having a fabric sheet member in accordance with the present invention.
Figure 2:
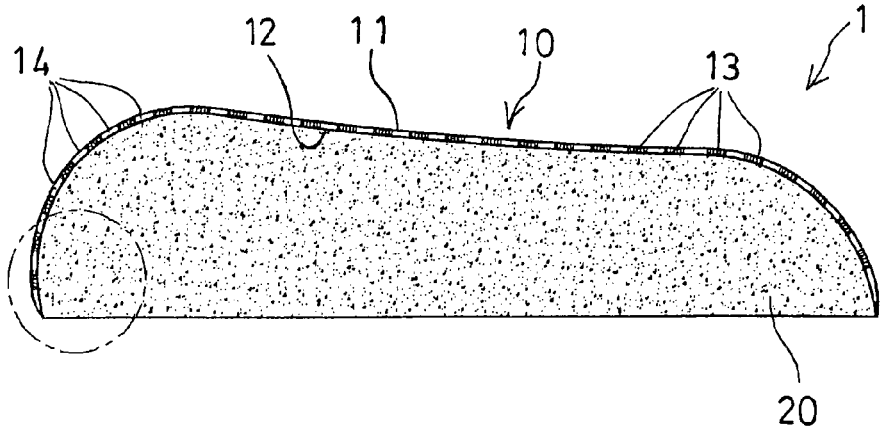
FIG. 2 is a cross sectional view of the cushioning element or device taken along lines 2-2 of FIG. 1.
Figure 3:
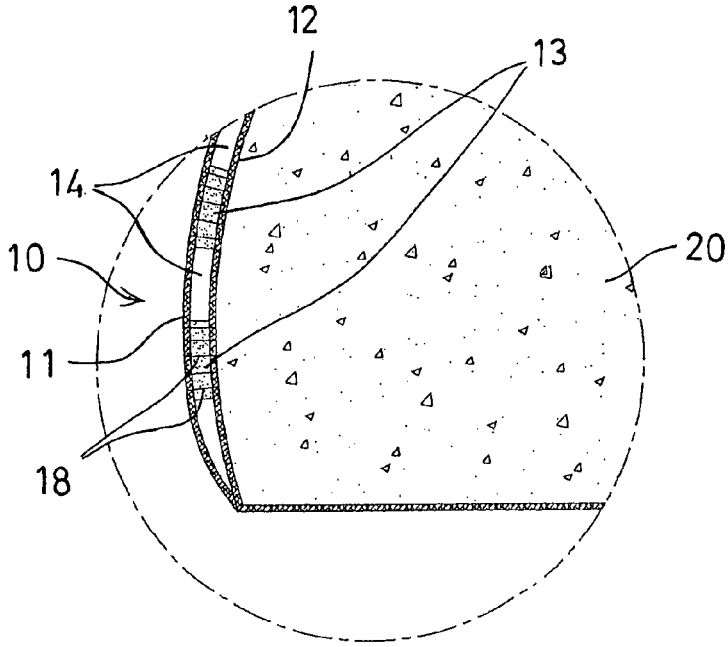
FIG. 3 is an enlarged partial cross sectional view of the cushioning element or device.
Figure 4:
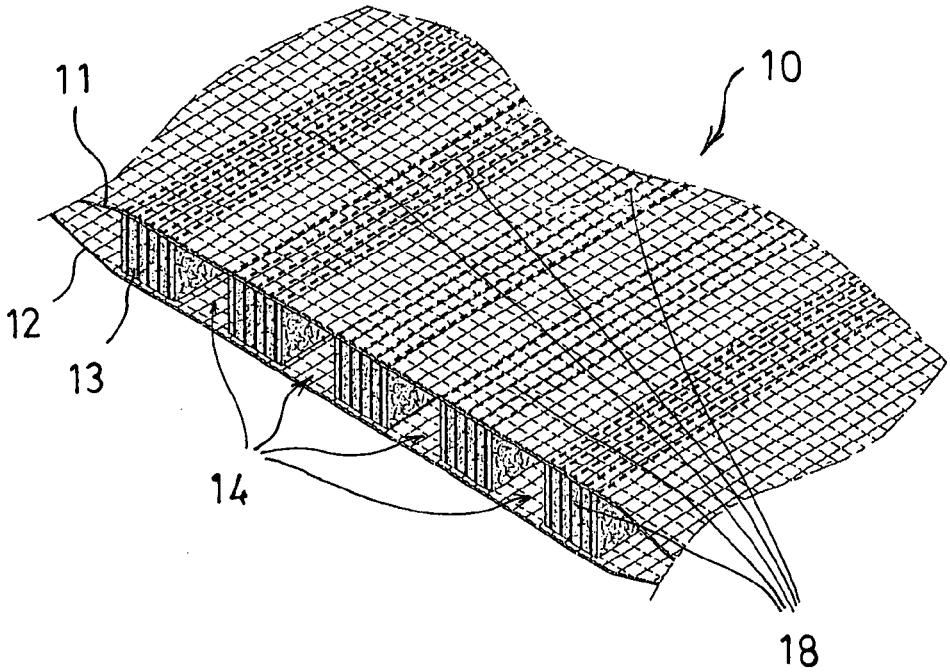
FIG. 4 is an enlarged partial perspective view illustrating the fabric sheet member to be attached or engaged onto the outer peripheral portion of the cushioning element or device.
Figure 5:
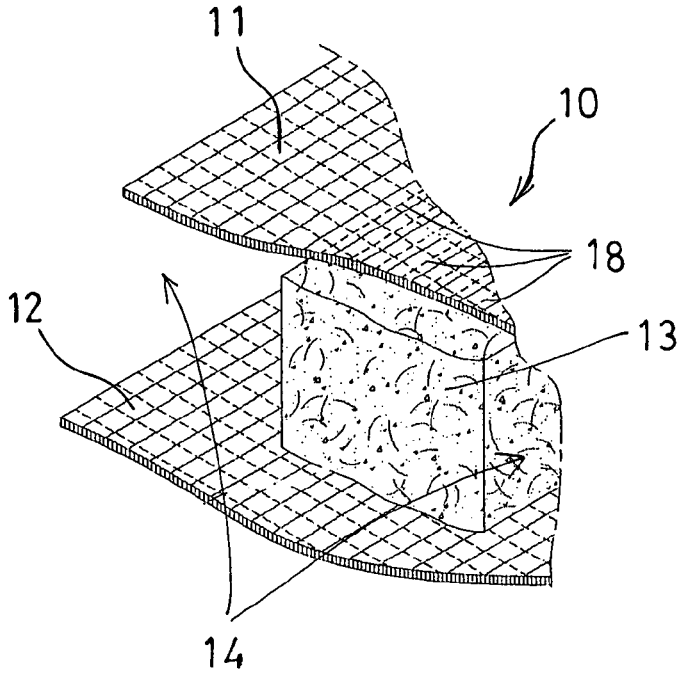
FIG. 5 is a further enlarged partial perspective view illustrating the fabric sheet member to be attached or engaged onto the outer peripheral portion of the cushioning element or device.
Figure 6:
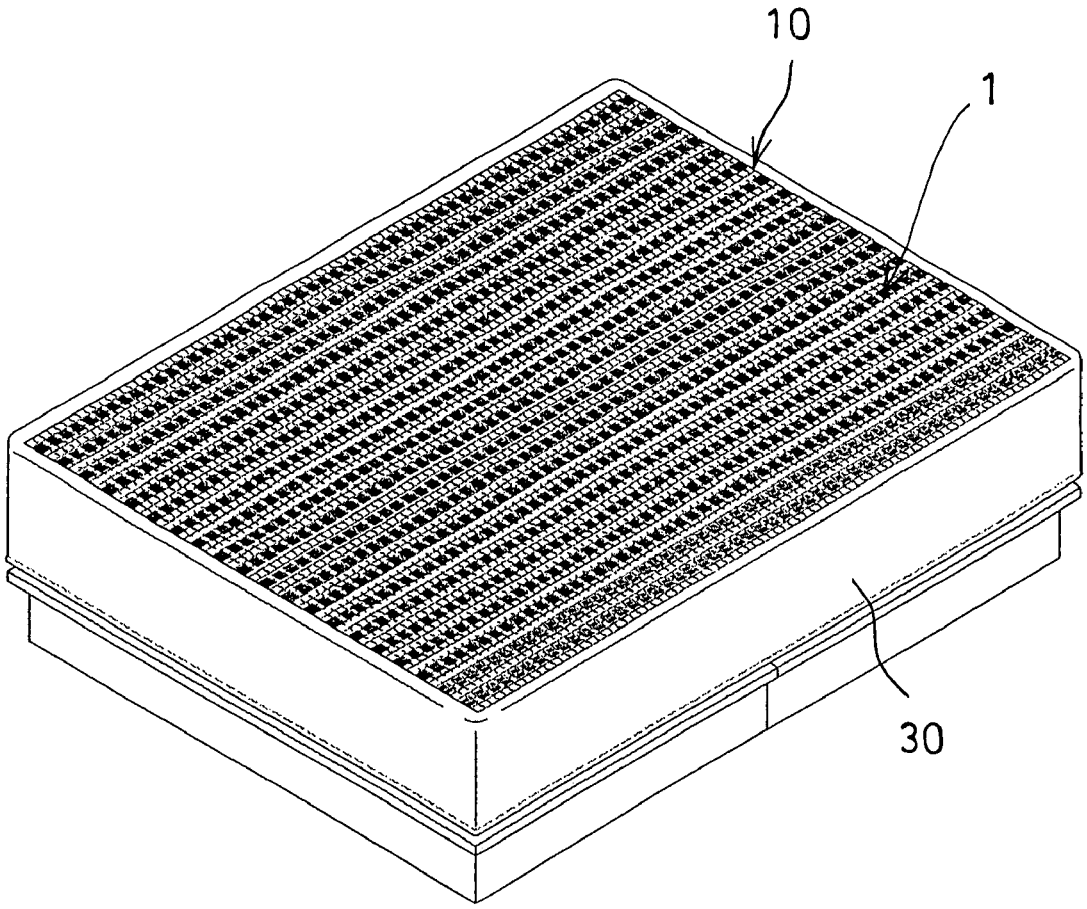
FIG. 6 is a perspective view illustrating a bed having the fabric sheet member attached or engaged onto the outer peripheral portion thereof.
Figure 7:
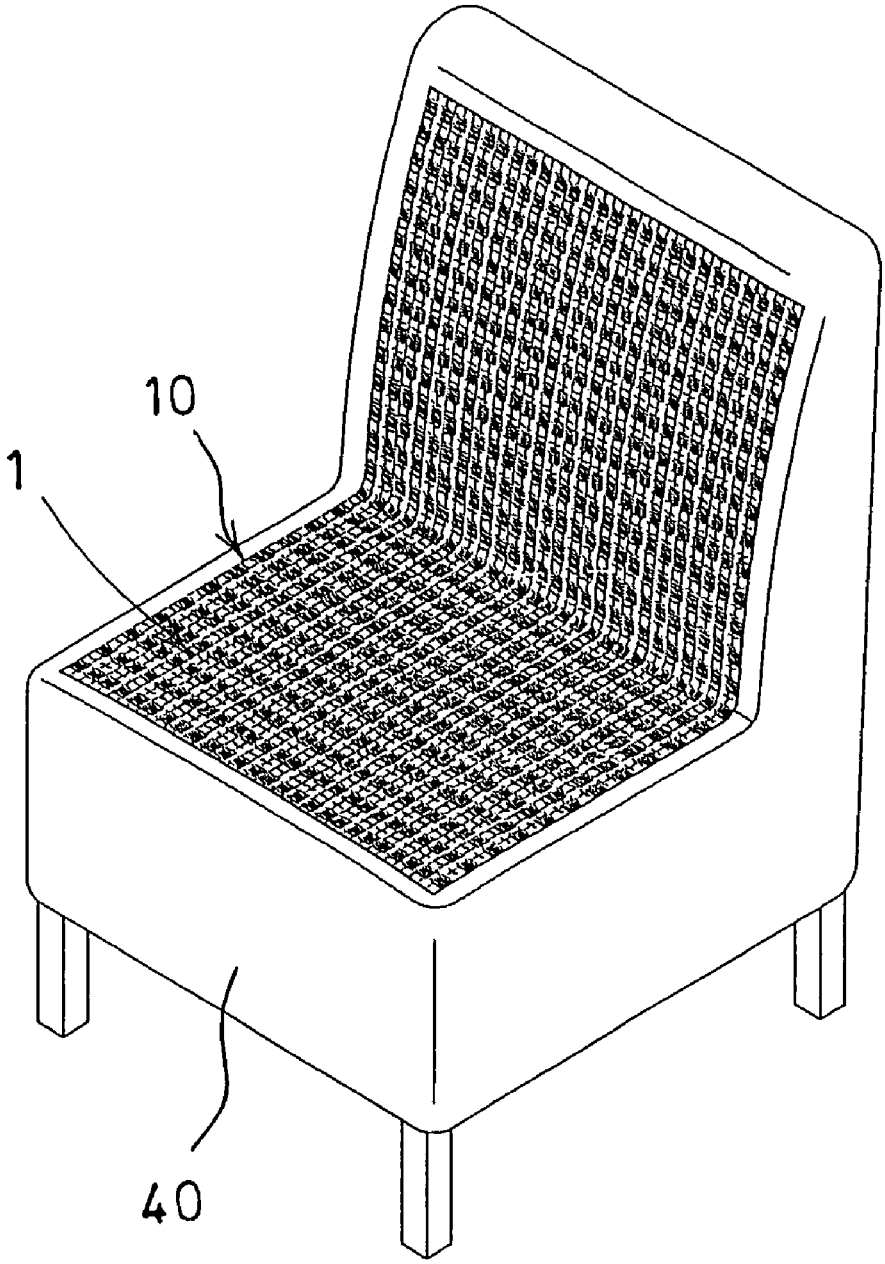
FIG. 7 is a perspective view illustrating a seat cushion for a chair having the fabric sheet member attached or engaged onto the outer peripheral portion thereof.

Referring to the drawings, and initially to FIGS. 1-5, a fabric sheet member 10 in accordance with the present invention is provided for attaching or engaging onto the outer peripheral portion of an inner cushioning body or member 20 for forming a cushioning device 1 in accordance with the present invention which may be formed or used or acted as a pillow as shown in FIGS. 1 and 2, or which may be attached or engaged into an outer bedstead 30 (FIG. 6) for forming a bed cushion, or which may be attached or engaged into a chair body 40 (FIG. 7) for forming a seat back and/or a seat cushion of a chair. The inner cushioning body or member 20 may be formed or made of various materials, such as foamable materials, foamed latex rubber materials, spongy materials, or other synthetic materials, and the like.

As shown in FIGS. 2-5, the fabric sheet member 10 comprises a cover fabric or cloth layer 11, an inner fabric or cloth layer 12, and one or more longitudinal fabric or cushioning elements 13 disposed or attached or engaged between the cover fabric or cloth layer 11 and the inner fabric or cloth layer 12, and secured to and between the cover fabric or cloth layer 11 and the inner fabric or cloth layer 12 with such as stitches 18 (FIGS. 3-5), fasteners or latches (not shown), adhesive materials, or the like, in order to space the cover fabric or cloth layer 11 and the inner fabric or cloth layer 12 from each other for a predetermined or suitable distance, and so as to form one or more gaps or compartments or spaces 14 between the longitudinal fabric or cushioning elements 13 and/or the cover fabric or cloth layer 11 and/or the inner fabric or cloth layer 12.

It is preferable that the cover fabric or cloth layer 11 and/or the inner fabric or cloth layer 12 may be made or formed by woven or non-woven cloth materials for allowing the cover fabric or cloth layer 11 and/or the inner fabric or cloth layer 12 to include an air permeable or circulating structure and for allowing the air to flow through the cover fabric or cloth layer 11 and/or the inner fabric or cloth layer 12. In addition, the air may also flow through the spaces 14 formed between the longitudinal fabric or cushioning elements 13 and/or the cover fabric or cloth layer 11 and/or the inner fabric or cloth layer 12 such that the fabric sheet member 10 may include an excellent air permeable or circulating structure.

It is preferable that the longitudinal fabric or cushioning elements 13 may be formed or made of various air permeable or circulating materials, such as fiber or fabric or cotton or filament materials (FIG. 5), spongy materials, or other foamable or synthetic or compartmented materials which allow the air to flow or to permeate or to circulate through the longitudinal fabric or cushioning elements 13 and which include an excellent resilience, an excellent stretchability, an excellent recovering characteristic, in order to provide an excellent resilience to the fabric sheet member 10.

It is to be noted that the longitudinal fabric or cushioning elements 13 may be easily disposed or attached or engaged between the cover fabric or cloth layer 11 and the inner fabric or cloth layer 12, and may be quickly secured to and between the cover fabric or cloth layer 11 and the inner fabric or cloth layer 12 with such as a stitching machine (not shown) for allowing the fabric sheet member 10 to be quickly made or manufactured in mass production and for allowing the fabric sheet member 10 to be made or manufactured with a greatly decreased cost or fee.

Accordingly, the fabric sheet member in accordance with the present invention includes an air permeable structure for attaching onto various cushioning elements or devices and for allowing the cushioning elements or devices also to have an air permeable structure.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A fabric sheet member comprising:

a cover cloth layer, an inner cloth layer, and at least two longitudinal fabric elements disposed between said cover cloth layer and said inner cloth layer, and secured to said cover cloth layer and said inner cloth layer for forming at least one air circulating space between said at least two longitudinal fabric elements and said cover cloth layer and said inner cloth layer.

2. The fabric sheet member as claimed in claim 1, wherein said at least two longitudinal fabric elements are secured to said cover cloth layer and said inner cloth layer with stitches.

3. The fabric sheet member as claimed in claim 1, wherein said at least two longitudinal fabric elements are made of resilient cotton materials.

4. The fabric sheet member as claimed in claim 1, wherein said at least two longitudinal fabric elements are made of resilient filament materials.

5. The fabric sheet member as claimed in claim 1, wherein said fabric sheet member is attachable onto an outer peripheral portion of an inner cushioning member for forming a pillow.

6. The fabric sheet member as claimed in claim 1, wherein said fabric sheet member is attachable onto an outer peripheral portion of an inner cushioning member for forming a bed cushion.

7. The fabric sheet member as claimed in claim 1, wherein said fabric sheet member is attachable onto an outer peripheral portion of an inner cushioning member for forming a seat cushion.

* * * * *